US005820484A

United States Patent [19]

Terry

[11] Patent Number: 5,820,484

[45] Date of Patent: Oct. 13, 1998

[54] GOLF BALL LOCATING SYSTEM

[76] Inventor: Delmar Terry, 1624 Collingwood Dr., Marietta, Ga. 30067

[21] Appl. No.: 828,058

[22] Filed: Mar. 28, 1997

[51] Int. Cl.[6] ..... A63B 43/00

[52] U.S. Cl. ..... 473/356

[58] Field of Search ..... 473/351, 357, 473/553, 134, 162, 164

[56] References Cited

U.S. PATENT DOCUMENTS

| | | | |
|---|---|---|---|
| 3,782,730 | 1/1974 | Horchler | 473/353 |
| 4,289,032 | 9/1981 | Tominaga | 473/351 |
| 5,112,055 | 5/1992 | Barnhill | 473/353 |
| 5,132,622 | 7/1992 | Valentino | 473/353 |
| 5,423,549 | 6/1995 | Englmeier | 473/353 |
| 5,447,314 | 9/1995 | Yamazaki | 473/353 |
| 5,480,154 | 1/1996 | Barnhill | 473/353 |
| 5,626,531 | 5/1997 | Little | 473/353 |

FOREIGN PATENT DOCUMENTS

| | | | |
|---|---|---|---|
| 2583648 | 12/1986 | France | 473/164 |
| 4218712 | 12/1993 | Germany | 473/164 |
| 2277037 | 10/1994 | United Kingdom | 473/164 |

*Primary Examiner*—Theatrice Brown

[57] ABSTRACT

A new Golf Ball Locating System for allowing golfers to easily find their golf balls. The inventive device includes a golf ball which includes a core that is surrounded by concave metal plates and a remote control device.

7 Claims, 4 Drawing Sheets

FIG. 3
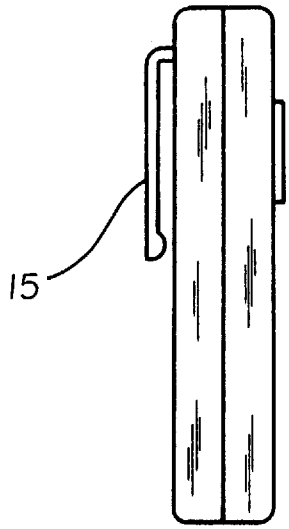
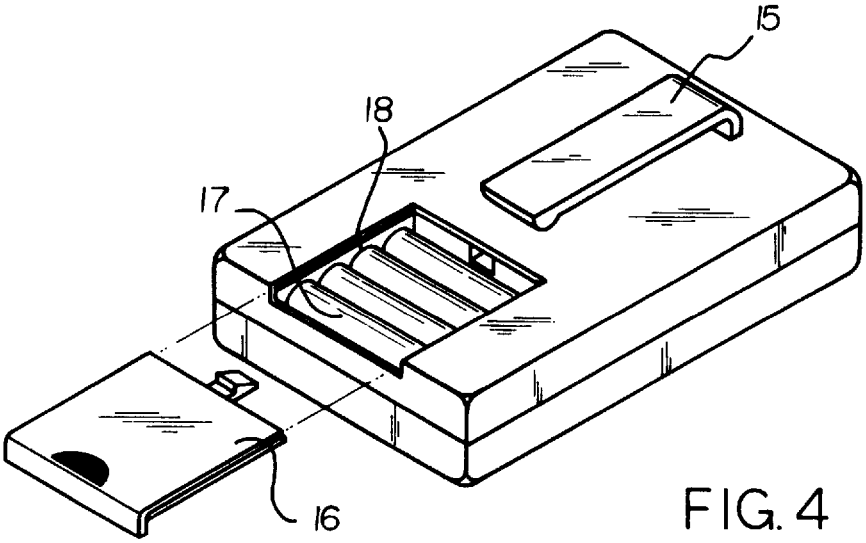
FIG. 4

FIG 7
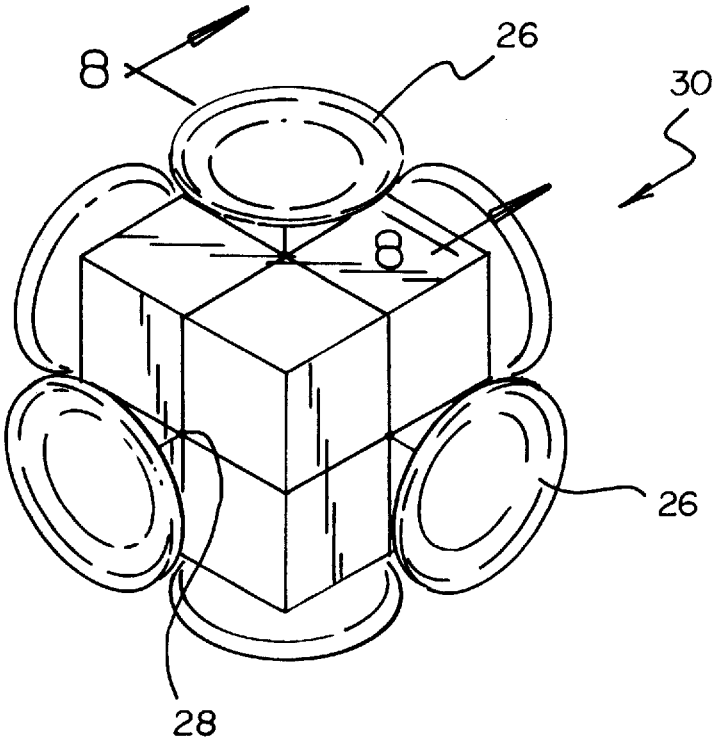
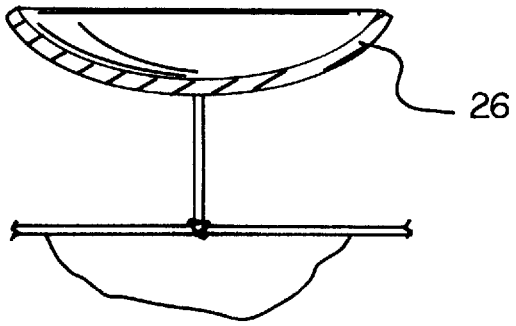
FIG 8

GOLF BALL LOCATING SYSTEM

BACKGROUND OF THE INVENTION

1. Field of the Invention

The present invention relates to golf balls which can be located by emitting a sound and more particularly pertains to a new Golf Ball Locating System for allowing golfers to easily find their golf balls.

2. Description of the Prior Art

The use of golf balls which can be located by emitting a sound is known in the prior art. More specifically, golf balls which can be located by emitting a sound heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf balls which can be located by emitting a sound include U.S. Pat. No. 5,447,314; U.S. Pat. No. 5,423,549; U.S. Pat. No. 5,112,055; U.S. Pat. No. 247,685; U.S. Pat. No. 5,434,789 and U.S. Pat. No. 4,675,816.

While these devices fulfill their respective, particular objectives and requirements, the aforementioned patents do not disclose a new Golf Ball Locating System. The inventive device includes a golf ball which includes a core that is surrounded by concave metal plates and a remote control device.

In these respects, the Golf Ball Locating System according to the present invention substantially departs from the conventional concepts and designs of the prior art, and in so doing provides an apparatus primarily developed for the purpose of allowing golfers to easily find their golf balls.

SUMMARY OF THE INVENTION

In view of the foregoing disadvantages inherent in the known types of golf balls which can be located by emitting a sound now present in the prior art, the present invention provides a new Golf Ball Locating System construction wherein the same can be utilized for allowing golfers to easily find their golf balls.

The general purpose of the present invention, which will be described subsequently in greater detail, is to provide a new Golf Ball Locating System apparatus and method which has many of the advantages of the golf balls which can be located by emitting a sound mentioned heretofore and many novel features that result in a new Golf Ball Locating System which is not anticipated, rendered obvious, suggested, or even implied by any of the prior art golf balls which can be located by emitting a sound, either alone or in any combination thereof.

To attain this, the present invention generally comprises a golf ball which includes a core that is surrounded by concave metal plates and a remote control device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Golf Ball Locating System apparatus and method which has many of the advantages of the golf balls which can be located by emitting a sound mentioned heretofore and many novel features that result in a new Golf Ball Locating System which is not anticipated, rendered obvious, suggested, or even implied by any of the prior art golf balls which can be located by emitting a sound, either alone or in any combination thereof.

It is another object of the present invention to provide a new Golf Ball Locating System which may be easily and efficiently manufactured and marketed.

It is a further object of the present invention to provide a new Golf Ball Locating System which is of a durable and reliable construction.

An even further object of the present invention is to provide a new Golf Ball Locating System which is susceptible of a low cost of manufacture with regard to both materials and labor, and which accordingly is then susceptible of low prices of sale to the consuming public, thereby making such Golf Ball Locating System economically available to the buying public.

Still yet another object of the present invention is to provide a new Golf Ball Locating System which provides in the apparatuses and methods of the prior art some of the advantages thereof, while simultaneously overcoming some of the disadvantages normally associated therewith.

Still another object of the present invention is to provide a new Golf Ball Locating System for allowing golfers to easily find their golf balls.

Yet another object of the present invention is to provide a new Golf Ball Locating System which includes a golf ball which includes a core that is surrounded by concave metal plates and a remote control device.

Still yet another object of the present invention is to provide a new Golf Ball Locating System that makes a golf ball emit a sound when a remote control device is activated.

Even still another object of the present invention is to provide a new Golf Ball Locating System which comprises a golf ball that has a transmitter/receiver cube with six concave metal plates serving as part of the antenna system disposed in the center of the ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is side view of the remote control of the present invention.

FIG. 4 is an exploded view of the remote control of the present invention.

FIG. 7 is an exploded view of the core of another embodiment of the present invention.

FIG. 8 is a cross sectional view taken along line 8—8 of FIG. 7.

DESCRIPTION OF THE PREFERRED EMBODIMENT

Figure 1:
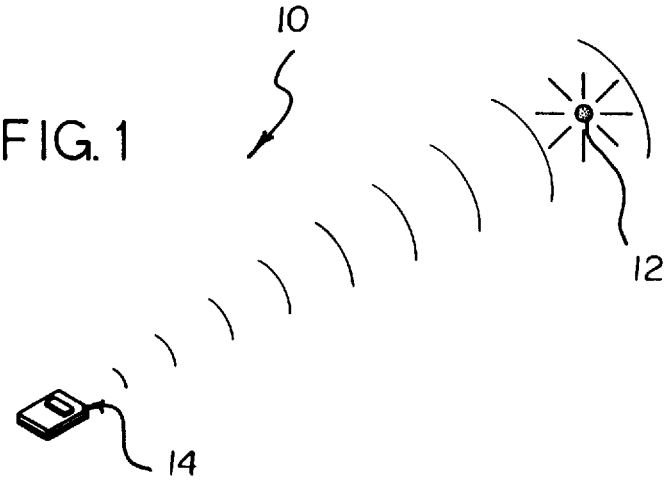
FIG. 1 is a side view of a new Golf Ball Locating System according to the present invention.
Figure 2:
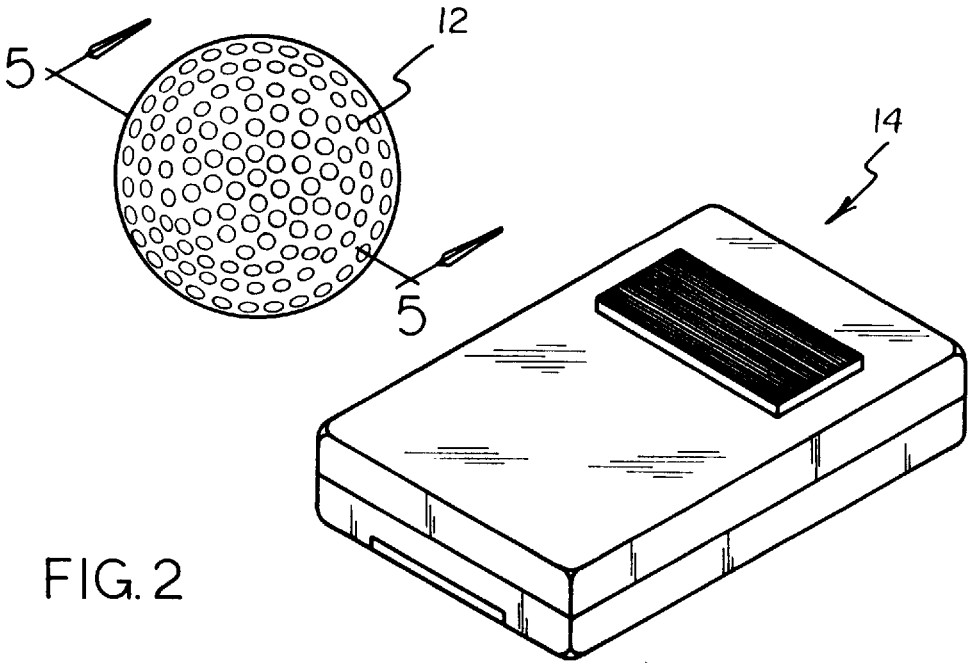
FIG. 2 is a side perspective view of the remote control and the ball of the present invention.
Figure 5:
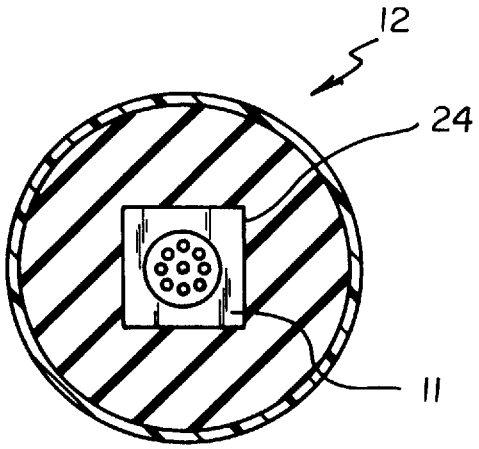
FIG. 5 is a cross sectional view taken along line 4—4 of FIG. 2.
Figure 9:
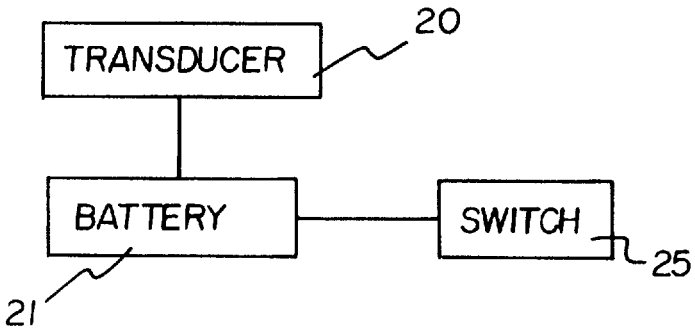
FIG. 9 is a flow chart of the operating system of the present invention.
Figure 6:
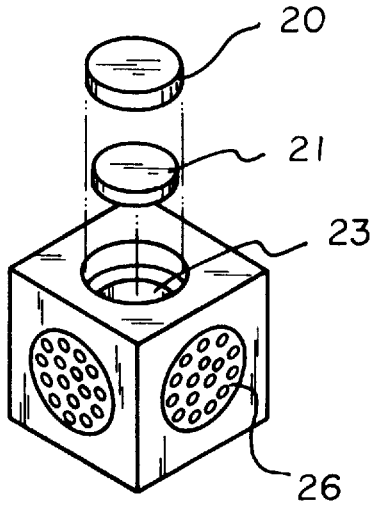
FIG. 6 is an exploded view of the core of the ball.

With reference now to the drawings, and in particular to FIGS. 1 through 9 thereof, a new Golf Ball Locating System embodying the principles and concepts of the present invention and generally designated by the reference numeral 10 will be described.

More specifically, it will be noted that the Golf Ball Locating System 10 comprises a golf ball which includes a core that is surrounded by concave metal plates and a remote control device As best illustrated in FIGS. 1 through 9, it can be shown that the present invention teaches a novel nonobvious Golf Ball Locating System that finds use in the industry.

The present invention generally includes A Golf Ball Locating System 10 which comprising a golf ball 12. The purpose of the present invention is to assist golfers to easily find their golf balls by using subsonic sounds to recover such. The golf ball 12 consist of an inner core 11, wherein the inner core 11 can have a cubed device 13 that is surrounded by concave metal plates 26. The cubed device 13 can forms an subsonic generating means and a subsonic means for receiving the subsonic sounds emitted from the golf ball 12. The outer core material 24 can be a rubbery shock absorbing type material.

The metal plates 26 can either be imbedded in each sides of the cubed device 13 or form at least six protrusions from each side of the cubed device 13. The subsonic sound generating means comprises a subsonic transducer 20, battery means 21 for providing energy to the subsonic transducer battery means 21 for energizing the subsonic transducer 20 and switching means 25 for turning the ultrasonic transducer 20 on and off.

The switching means 25 further comprises magnetometer means for sensing a magnetic field and electronic circuit means connecting the magnetometer means 23 to the subsonic transducer means 20 so that the subsonic sound emitted by the golf ball 12 can be turned on and off by passing a magnetic field close to the golf ball 12.

The sensing means 14 is preferably a hand held device with a clip 15 that can be attached to a pocket or belt loop. The sensing means 14 includes a battery case 18 with a set of batteries 17 and a battery cover 16 for the case 18. The sensing means is designed to receive the subsonic signals sent out by the ball 12 and read out on a LCD screen. This technology is not described in detail as it is well know in the art, for example U.S. Pat. No. 5,447,314 described the use of ultrasonic sound generating systems.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf ball locating system comprising:

a golf ball consisting of an inner core surrounded by an outer covering, said inner core comprising a cubic-shaped device that is surrounded by concave metal transmitting plates and wherein said cubic-shaped device forms a subsonic sound generating means for generating a subsonic sound; and a subsonic sound receiving means for receiving the subsonic sounds emitted from said golf ball.

2. The golf ball locating system of claim 1 wherein the outer covering comprises a shock absorbing compressible material.

3. The golf ball locating system of claim 1 wherein the transmitting plates are embedded in the compressible material of the outer covering.

4. The golf ball locating system of claim 1 wherein the subsonic sound generating means include at least six transmitting plates, with each plate protruding from a side of the cubic-shaped device.

5. The golf ball locating system of claim 1 wherein said subsonic sound generating means comprises:

a subsonic transducer, battery means for providing energy to said subsonic transducer, and switching means for turning said subsonic transducer on and off.

6. The golf ball locating system of claim 5 wherein the switching means further comprises:

magnetometer means for sensing a magnetic field, and electronic circuit means connecting said magnetometer means to said subsonic transducer so that said subsonic sound emitted by the golf ball can be turned on and off by passing a magnetic field close to said golf ball.

7. A golf ball locating system comprising:

a golf ball comprising an inner core surrounded by an outer covering formed of a shock absorbing compressible material, a subsonic sound generating means for generating a subsonic sound signal, said subsonic sound generating means being located in said inner core and including transmitting plates embedded in the outer covering of said golf ball; and a detector unit including a subsonic sound detecting means for detecting a subsonic sound signal emitted from the subsonic sound generating means in said golf ball;

said subsonic sound generating means comprises at least six transmitting plates;

said subsonic sound generating means comprises:

a subsonic transducer, battery means for providing energy to said subsonic transducer, and switching means for selectively supplying power to said subsonic transducer;

said switching means of said sound generating means further comprises and magnetometer means for sensing a magnetic field, and electronic circuit means connecting said magnetometer means to said subsonic transducer so that the subsonic sound generating means in said golf ball can be selectively turned on and off by passing a magnetic field close to said golf ball.

* * * * *